US006203954B1

(12) United States Patent
Anayama

(10) Patent No.: US 6,203,954 B1
(45) Date of Patent: Mar. 20, 2001

(54) ELECTROPHOTOGRAPHIC PHOTOSENSITIVE MEMBER PROCESS CARTRIDGE AND ELECTROPHOTOGRAPHIC APPARATUS

(75) Inventor: Hideki Anayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/344,112

(22) Filed: Jun. 24, 1999

(30) Foreign Application Priority Data

Jun. 30, 1998 (JP) ..... 10-184982

(51) Int. Cl.[7] ..... G03G 5/14
(52) U.S. Cl. ..... 430/67; 430/66; 399/159
(58) Field of Search ..... 430/67, 66; 399/159

(56) References Cited

U.S. PATENT DOCUMENTS

| | | | | |
|---|---|---|---|---|
| 4,962,008 | | 10/1990 | Kimura | 430/66 |
| 5,213,928 | * | 5/1993 | Yu | 430/66 |
| 5,357,320 | * | 10/1994 | Kashimura et al. | 399/159 |
| 5,935,747 | | 8/1999 | Miyazaki et al. | 430/58 |

FOREIGN PATENT DOCUMENTS

| | | |
|---|---|---|
| 0651295 | 10/1994 | (EP) . |
| 0811885 | 10/1997 | (EP) . |

* cited by examiner

*Primary Examiner*—Mark Chapman
(74) *Attorney, Agent, or Firm*—Fitzpatrick, Cella, Harper & Scinto

(57) ABSTRACT

An electrophotographic photosensitive member includes a support member and a photosensitive layer formed thereon. A surface layer of the electrophotographic photosensitive member contains diorganopolysiloxane represented by the following formula (1):

(1)

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$, B and D, X represents an integer of 0 to 1000, and Y and Z independently represent an integer of 1 to 1000.

33 Claims, 1 Drawing Sheet

ELECTROPHOTOGRAPHIC PHOTOSENSITIVE MEMBER PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each comprising the electrophotographic photosensitive member. Particularly, the present invention relates to an electrophotographic photosensitive member comprising a surface layer containing a specified silicone resin, and a process cartridge and an electrophotographic apparatus each comprising the electrophotographic photosensitive member.

2. Description of the Related Art

An electrophotographic photosensitive member is required to have sensitivity, electric characteristics and optical characteristics according to the electrophotographic process used. Particularly, the repeated use of an electrophotographic photosensitive member causes direct application of electric and mechanical external forces for charging, image exposure, toner development, transfer, cleaning, etc., and thus durability against these forces is also required. Specifically, durability is required against chemical deterioration due to ozone and nitrogen compounds produced in charging, and mechanical and electric deterioration due to discharge during charging and sliding friction of a cleaning member.

Unlike an inorganic photosensitive member, an electrophotographic photosensitive member comprising a relatively soft material containing an organic photoconductive substance exhibits low durability against mechanical deterioration, and thus various attempts have been made to satisfy durability characteristics.

Particularly, as a method for effectively preventing mechanical deterioration to improve durability, the friction coefficient of the surface of an electrophotographic photosensitive member is decreased by containing a fluororesin powder in the surface layer of the electrophotographic photosensitive member. This method causes smooth sliding friction with a cleaning member, thereby preventing application of strong shear stress to the surface of the electrophotographic photosensitive member.

However, a fluororesin powder has low surface tension, and is thus difficult to uniformly disperse in a resin having relatively high surface tension. Therefore, combinations with various auxiliary dispersants are proposed. However, while many of commercially available auxiliary dispersants have excellent dispersibility for fluororesins, and thus have complicated structures, they cause difficulties in stabilizing secondary aggregations of a fluororesin during dispersion. This problem is particularly significant in an electrophotographic photosensitive member having a thin surface layer having a thickness of about 1 to 100 $\mu$m, causing spots or fogging in an image.

The auxiliary dispersant also causes a potential change due to carrier trapping.

SUMMARY OF THE INVENTION

Accordingly, it is an object of the present invention to solve the problems of a conventional surface layer containing a fluororesin powder dispersed in a binder resin, and provide an electrophotographic photosensitive member comprising a surface layer containing a fluororesin powder uniformly dispersed therein, and thus exhibiting excellent durability performance and no problem in electrophotographic properties and maintaining excellent surface lubricity.

Another object of the present invention is to provide a process cartridge and an electrophotographic photosensitive apparatus each comprising the above-described electrophotographic photosensitive member.

In order to achieve the objects, the present invention provides an electrophotographic photosensitive member comprising a support member, and a photosensitive layer formed on the support member, wherein a surface layer of the electrophotographic photosensitive member contains diorganopolysiloxane represented by the following formula (1):

(1)

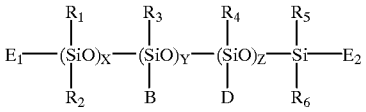

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$ B and D; X represents an integer of 0 to 1000; and Y and Z independently represent an integer of 1 to 1000.

The present invention also provides a process cartridge and an electrophotographic apparatus each comprising the above electrophotographic photosensitive member.

Further objects, features and advantages of the present invention will become apparent from the following description of the preferred embodiments with reference to the attached drawings.

DESCRIPTION OF THE PREFERRED EMBODIMENT

Figure 1:
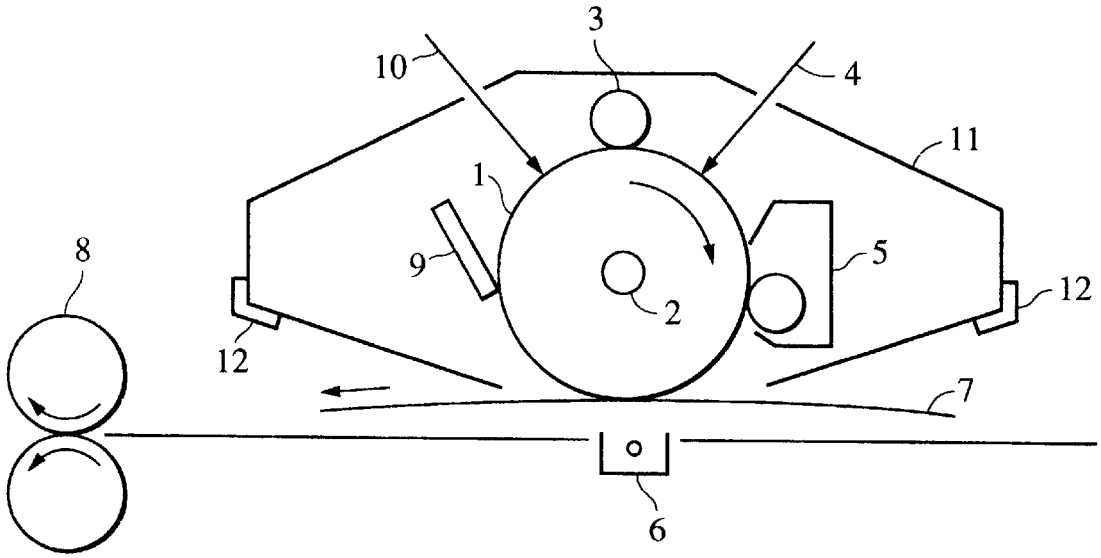
FIG. 1 is a drawing showing the schematic configuration of an electrophotographic apparatus comprising a process cartridge comprising an electrophotographic photosensitive member of the present invention.

An electrophotographic photosensitive member of the present invention comprises a surface layer containing diorganopolysiloxane represented by the following formula (1):

(1)

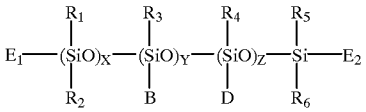

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$, B and D; X represents an integer of 0 to 1000; and Y and Z independently represent an integer of 1 to 1000.

Examples of hydrocarbon groups of $R_1$ to $R_6$ in formula (1) include an alkyl group, an alkenyl group, an aryl group, an arylalkyl group having 1 to 30 carbon atoms, and the like. Of these groups, a methyl group and a phenyl group are preferable. $R_1$ to $R_6$ may be the same or different.

B represents a substituted or unsubstituted organic group having a perfluoroalkyl group; B is preferably represented by the following formula (2):

$$—R_7—(CF_2)_a—F \quad (2)$$

wherein $R_7$ represents an alkylene group or an alkyleneoxyalkylene group, and a represents an integer of 3 or more.

Examples of alkylene groups of $R_7$ include an ethylene group, a propylene group and the like; Examples of alkyleneoxyalkylene groups of $R_7$ include an ethyleneoxyethylene group, an ethyleneoxypropylene group, a propyleneoxypropylene group, and the like.

A substituted or unsubstituted organic group D having a polyoxyalkylene group is preferably represented by the following formula (3):

$$—(R_8)_b—O—(R_9O)_c—R_{10} \quad (3)$$

wherein $R_8$ and $R_9$ independently represent a hydrocarbon group, $R_{10}$ represents a hydrogen atom, a hydrocarbon group, or an acyl group, b represents 0 or 1, and c represents an integer of 1 to 300.

Examples of hydrocarbon groups of $R_8$ and $R_9$ include alkylene groups such as a methylene group, an ethylene group, a propylene group, and the like; arylene groups such as a phenylene group and the like. $R_8$ and $R_9$ may be the same or different, and $R_9$ preferably has 1 to 4 carbon atoms. Examples of hydrocarbon groups of $R_{10}$ include alkyl groups such as a methyl group, an ethyl group, a propyl group, and the like; aryl groups such as a phenyl group, and the like. c is preferably 5 or more.

Examples of alkyl groups of D having at least 12 carbon atoms include a n-dodecyl group, a n-tetradecyl group, a n-hexadecyl group, a n-octadecyl group, and the like, which preferably have 100 carbon atoms or less.

A substituted or unsubstituted organic group D having a siloxane group is preferably represented by the following formula (4):

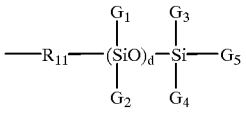

(4)

wherein $R_{11}$ represents an alkylene group, an alkyleneoxy group, or an oxygen atom; $G_1$ to $G_5$ independently represents a substituted or unsubstituted alkyl or a substituted or unsubstituted aryl group; and d represents an integer of 3 or more.

Examples of alkylene groups of $R_{11}$ include an ethylene group, a propylene group, and the like; examples of alkyleneoxyalkylene groups include an ethyleneoxyethylene group, an ethyleneoxypropylene group, a propyleneoxypropylene group, and the like. Examples of alkyl groups of $G_1$ to $G_5$ include a methyl group, an ethyl group, and the like; examples of aryl groups include a phenyl group, and the like. $G_1$ to $G_5$ may be the same or different. d is an integer of 3 or more, and preferably an integer of 5 or more.

Examples of substituents which may be possessed by the above groups include halogen atoms such as a fluorine atom, a chlorine atom, an iodine atom, and the like; alkyl groups such as a methyl group, an ethyl group, a propyl group, and the like; aryl groups such as a phenyl group, and the like.

X is an integer of 0 to 1000, and preferably an integer of 10 to 200.

Y is an integer of 1 to 1000, and preferably an integer of 10 to 200.

Z is an integer of 1 to 1000, and preferably an integer of 5 to 100.

The total X+Y+Z is preferably 2 to 2000, more preferably 5 to 1000, and most preferably 20 to 500. The total Y+Z is preferably 10 to 30.

In the present invention, where each of X, Y and Z is 2 or more, each of $R_1$ to $R_4$, B and D may include two groups or more. For example, where Y is 3, three groups B may be the same or include two same groups and a different group, or three different groups. An example of such groups is compound (1–8) below. This is true for $R_9$ of Formula (3), and $G_1$ and $G_2$ of Formula (4).

Although, in Formula (1), the number of siloxane units having $R_1$ and $R_2$ is represented by X, the number of siloxane units having $R_3$ and B is represented by Y, and the number of siloxane units having $R_4$ and D is represented by Z for the sake of convenience, these units may be mixed. Namely, siloxane units having $R_1$ and $R_2$ and siloxane unit having $R_3$ and b may be present alternately. For example, these units may be bound as follows:

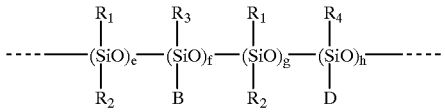

wherein $R_1$ to $R_4$, B and D are defined as the same as Formula (1), and e, f, g and h independently represent an integer.

Preferable examples of diorganopolysiloxane represented by formula (1) include the following compounds.

(1-1)
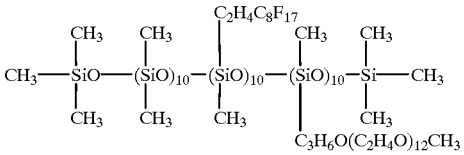
(1-2)
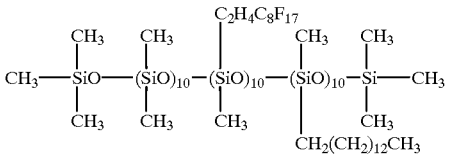
(1-3)
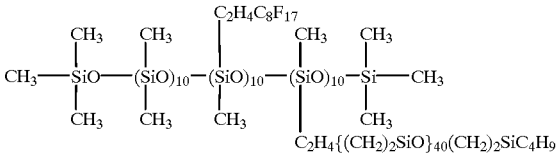
(1-4)
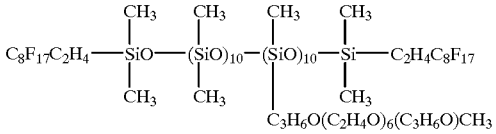
(1-5)
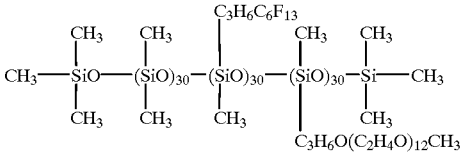
(1-6)
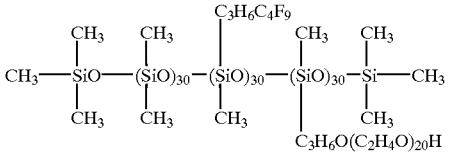
(1-7)
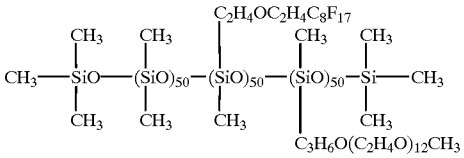
(1-8)
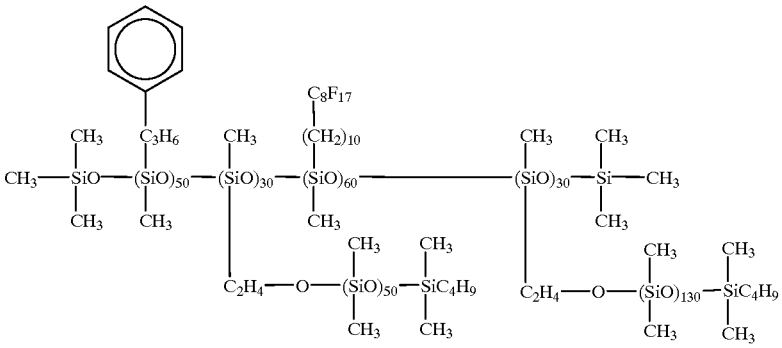
(1-9)
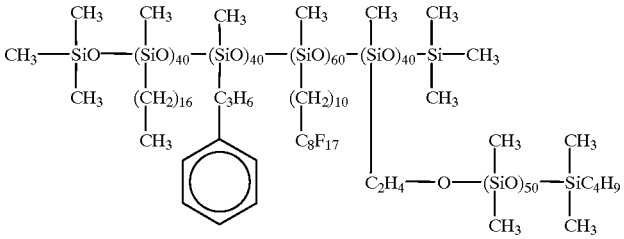
(1-10)
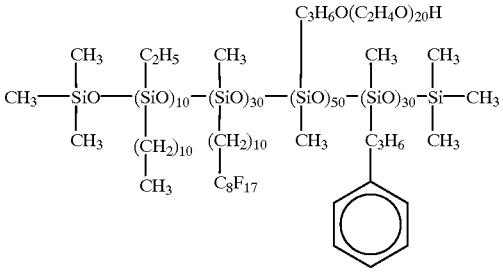

-continued (1-11)

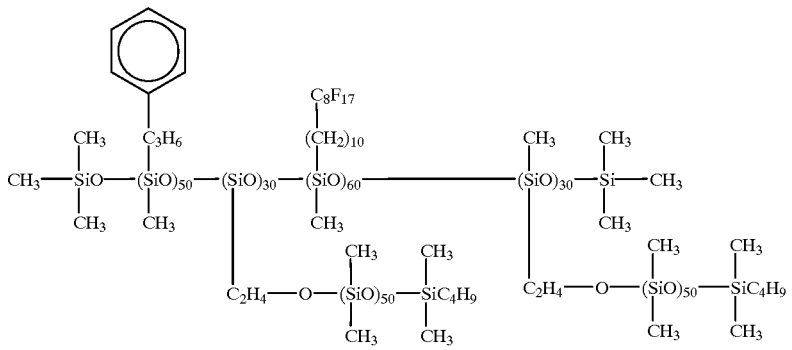

(1-12)

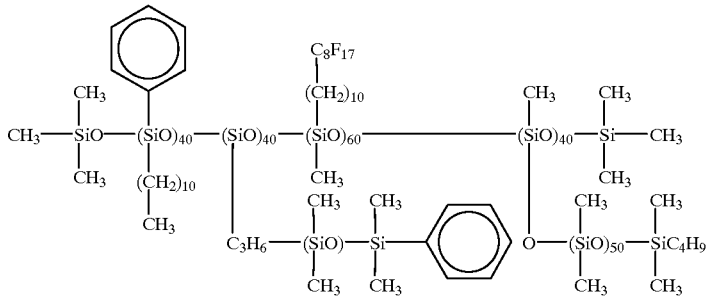

(1-13)

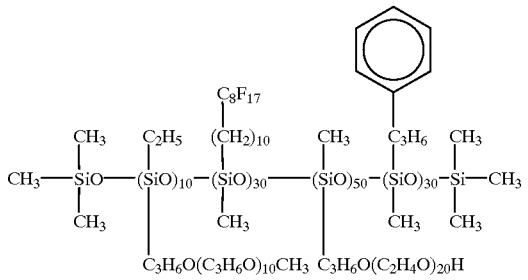

The weight average molecular weight of diorganopolysiloxane used in the present invention is preferably 1,000 to 1,000,000, more preferably 10,000 to 200,000.

The content of fluorine atoms in diorganopolysiloxane is preferably 1 to 80% by weight, more preferably 5 to 60% by weight, based on the total weight of diorganopolysiloxane. With a fluorine atom content of less than 1% by weight, the dispersion stabilizing ability of the fluororesin powder cannot be sufficiently exhibited, while with a content of over 70% by weight, compatibility with the binder resin deteriorates.

Although the reason for obtaining the significant effect of the present invention is not known, it is thought that since an organic group B containing a perfluoroalkyl group exhibits affinity for the fluororesin powder, an organic group D which is a non-fluorine substituent exhibits affinity for the binder resin, and the polyorganosiloxane chain exhibits high flexibility, diorganopolysiloxane is interposed between the fluororesin powder and the binder resin and has the function to accelerate dispersion of the fluororesin powder to the binder resin, and prevent aggregation of the fluororesin powder.

The construction of the electrophotographic photosensitive member of the present invention will be described below. The electrophotographic photosensitive member comprises a photosensitive layer formed on a support member. The photosensitive layer may be a monolayer type comprising a single layer containing a charge transport material and a charge generation material, or a multilayer type comprising a charge transport layer containing a charge transport material, and a charge generation layer containing a charge generation material. However, from the viewpoint of electrophotographic characteristics, the multilayer type is preferable.

As the support member, any material having conductivity, for example, a metal such as aluminum, stainless steel, or the like, a metal, paper, plastic, or the like with a conductive layer, may be used. The shape of the support member is a sheet, a cylinder, or the like.

In the present invention, a conductive layer may be provided between the support member and the photosensitive layer in order to prevent interference fringes or cover flaws of the support member. Such a conductive layer can be formed by dispersing a conductive powder of carbon black, metal particles, or the like in a binder resin. The thickness of the conductive layer is preferably 5 to 40 $\mu$m, more preferably 10 to 30 $\mu$m. The interference fringes can also be prevented by cutting a cylinder or alumite treatment.

Furthermore, an intermediate layer having an adhesive function or a barrier function may be provided on the support member or the conductive layer. Examples of materials for the intermediate layer include polyamide, polyvinyl alcohol, polyethylene oxide, ethyl cellulose, casein, polyurethane, polyether urethane, and the like. Any of these materials is dissolved in an appropriate solvent and then coated. The thickness of the intermediate layer is preferably 0.05 to 5 μm, more preferably 0.3 to 1 μm. With a cylinder treated with alumite or having a conductive film formed by a sol-gel method, the intermediate layer need not be used.

The charge generation layer is formed on the support member, conductive layer or intermediate layer. Examples of charge generation materials which can be used in the present invention include selenium-tellurium, pyrylium, and thiapyrylium dyes; phthalocyanine, anthoanthrone, dibenzpyrenequinone, tris-azo, cyanine, dis-azo, monoazo, indigo, quinacridone, and unsymmetrical quinocyanine dyes.

In the case of a function separation type, the charge generation layer is formed by sufficiently dispersing the charge generation material with 0.3- to 4-fold amounts of a binder resin and a solvent by using a homogenizer, an ultrasonic disperser, a ball mill, a vibrating ball mill, a sand mill, an attritor, a roll mill, or a liquid collision type high-speed disperser, coating the resultant dispersion, and then drying. However, the binder resin can be added after the charge generation material is dispersed, or the binder resin need not be used according to the characteristics of the charge generation material used. The thickness of the charge generation layer is preferably 5 μm or less, more preferably 0.1 to 2 μm.

The charge transport layer is mainly formed by dissolving the charge transport material and the binder resin, and in the case of the charge transport layer formed as the surface layer, further diorganopolysiloxane represented by formula (1), in a solvent, dispersing the fluororesin powder, coating the resultant coating solution, and drying. Examples of the charge transport material include triarylamine compounds, hydrazine compounds, stilbene compounds, pyrazoline compounds, oxazole compounds, triallylmethane compounds, thiazole compounds, and the like.

Examples of the binder resin used for the charge transport layer include thermoplastic binder resins and curing binder resins. Examples of such resins include phenoxy resins, polyacrylamide resins, polyvinylbutyral resins, polyarylate resins, polysulfone resins, polyamide resins, acryl resins, acrylonitrile resins, methacryl resins, vinyl chloride resins, vinyl acetate resins, phenol resins, epoxy resins, polyesters, alkyd resins, polycarbonate resins, polyurethane resins, and copolymers containing at least two of the repeating units of these resins, for example, such as styrene-butadiene copolymers, styrene-acrylonitrile copolymers, styrene-maleic acid copolymers, and the like. Also organic photoconductive polymers such as poly-N-vinylcarbazole, polyvinylanthracene, polyvinylpyrene, and the like can be used.

Of these resins, polyarylate resins and polycarbonate resins are preferable because these resins have high affinity for diorganopolysiloxane represented by formula (1) and the fluororesin, thereby forming a good coating solution. The polyarylate resins and polycarbonate resins have the constitutional units represented by the following formulae (5) and (6), respectively.

(5)

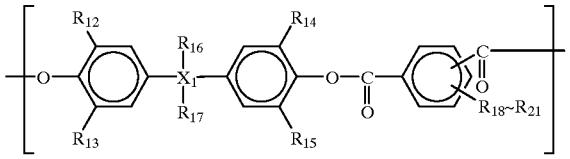

wherein $X_1$ represents a carbon atom or a single bond (in this case, $R_{16}$ and $R_{17}$ are absent); $R_{12}$ to $R_{15}$ independently represent a hydrogen atom, a halogen atom, a substituted or unsubstituted alkyl group, or a substituted or unsubstituted aryl group; and $R_{16}$ and $R_{17}$ independently represent a hydrogen atom, a halogen atom, a substituted or unsubstituted alkyl group, a substituted or unsubstituted aryl group, or a group necessary for forming a substituted or unsubstituted alkylidene group by combining $R_{16}$ and $R_{17}$. $R_{18}$ to $R_{21}$ independently represent a hydrogen atom, a halogen atom, a substituted or unsubstituted alkyl group or a substituted or unsubstituted aryl group.

(6)

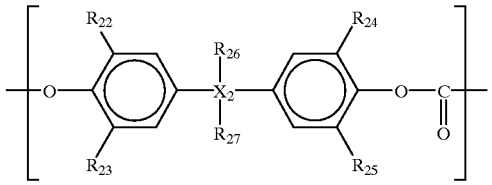

wherein $X_2$ represents a carbon atom or a single bond (in this case, $R_{26}$ and $R_{27}$ are absent); $R_{22}$ to $R_{25}$ independently represent a hydrogen atom, a halogen atom, a substituted or unsubstituted alkyl group, or a substituted or unsubstituted aryl group; $R_{26}$ and $R_{27}$ independently represent a hydrogen atom, a halogen atom, a substituted or unsubstituted alkyl group, a substituted or unsubstituted aryl group, or a group necessary for forming a substituted or unsubstituted alkylidene group by combining $R_{16}$ and $R_{17}$.

Examples of halogen atoms in formulae (5) and (6) include a fluorine atom, a chlorine atom, an iodine atom, and the like. Examples of alkyl groups include a methyl group, an ethyl group, a propyl group, and the like. Examples of aryl groups include a phenyl group, a naphthyl group, and the like. Examples of alkylidene groups include a cyclohexylidene group, and the like.

Examples of substituents which may be present in these groups include halogen atoms such as a fluorine atom, a chlorine atom, an iodine atom, and the like; alkyl groups such as a methyl group, an ethyl group, a propyl group, and the like; aryl groups such as a phenyl group, and the like.

Although preferable examples of constitutional units of polyarylate resins are given below, the polyarylate resins are not limited to these resins.

(5-1)

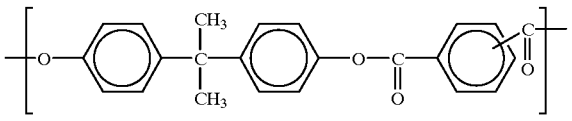

-continued
(5-2)
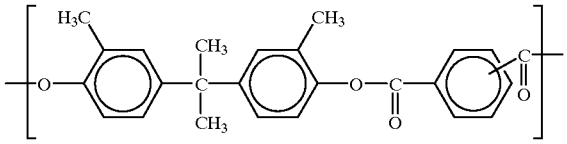
(5-3)
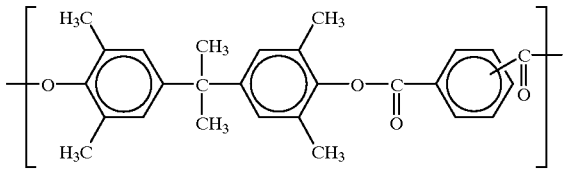
(5-4)
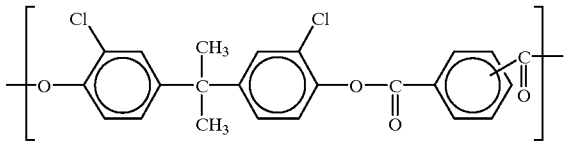
(5-5)
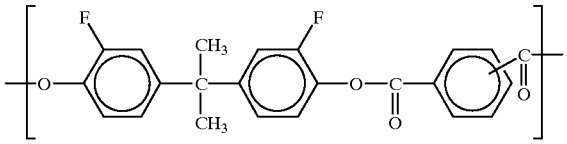
(5-6)
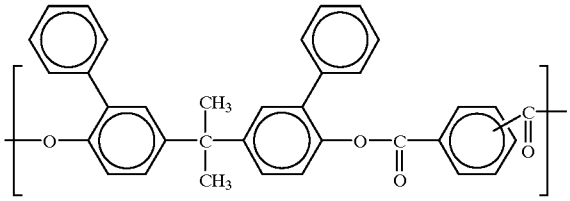
(5-7)
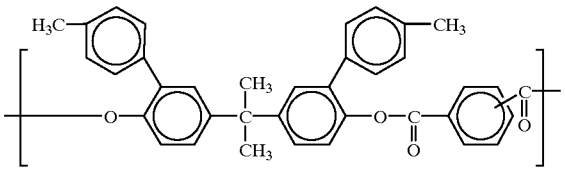
(5-8)
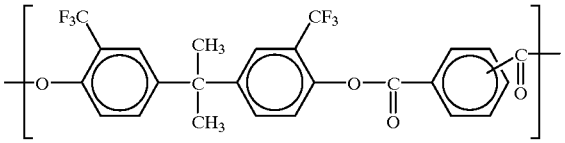
(5-9)
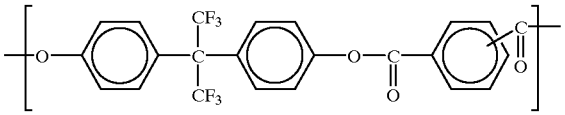
-continued
(5-10)
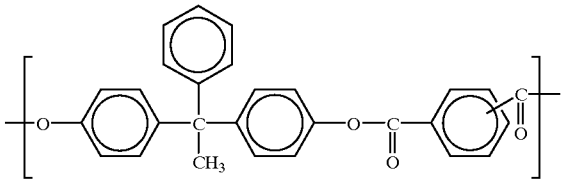
(5-11)
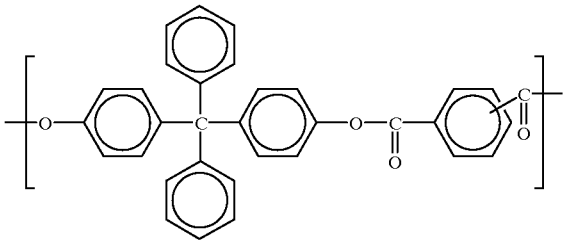
(5-12)
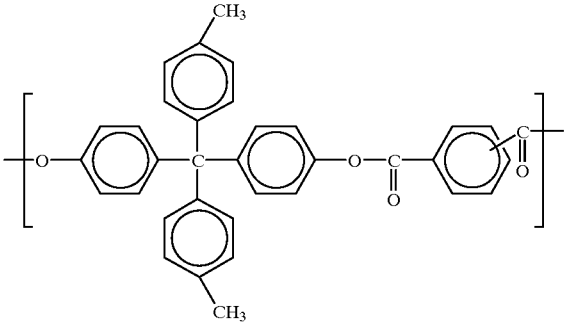
(5-13)
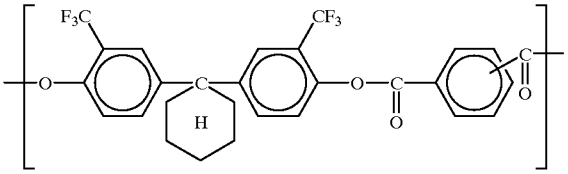
(5-14)
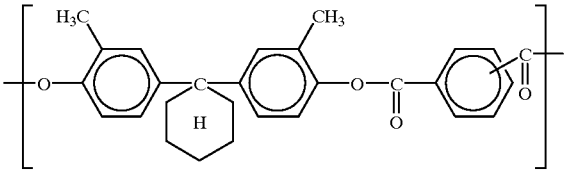
(5-15)
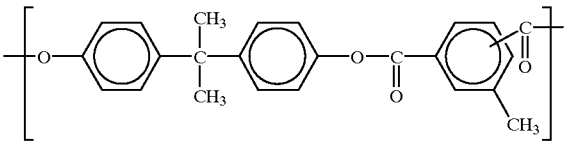

-continued
(5-16)
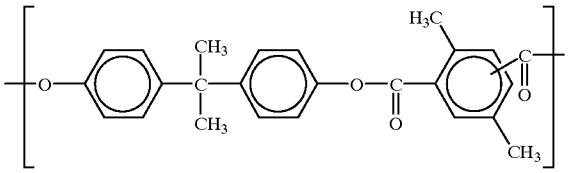
(5-17)
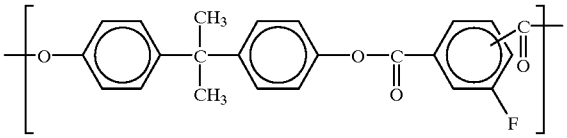
(5-18)
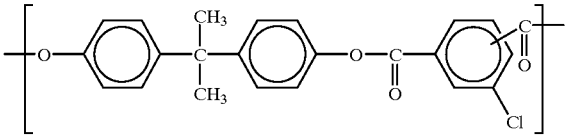
(5-19)
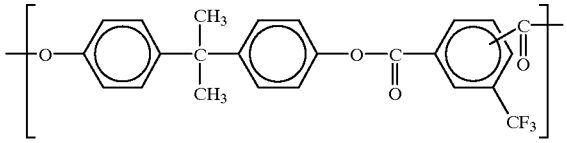
(5-20)
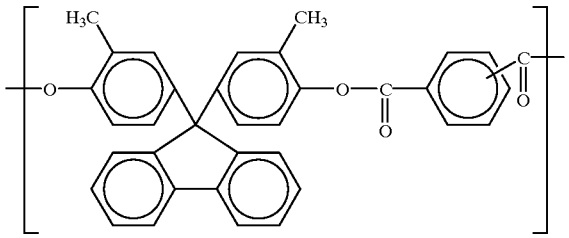
Although preferable examples of constitutional units of polycarbonate resins are given below, the polycarbonate resins are not limited to these resins.
(6-1)
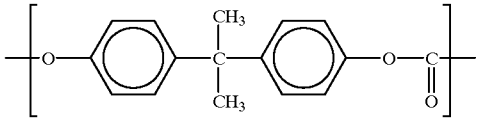
(6-2)
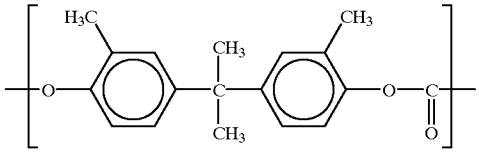
-continued
(6-3)
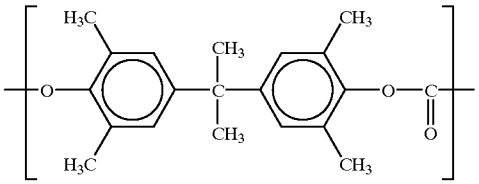
(6-4)
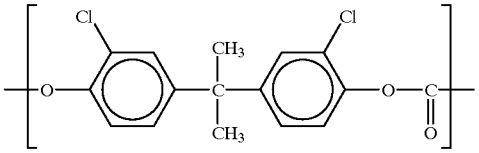
(6-5)
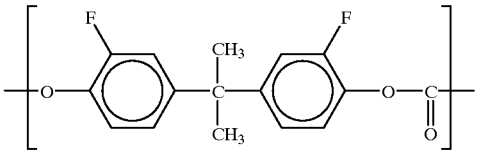
(6-6)
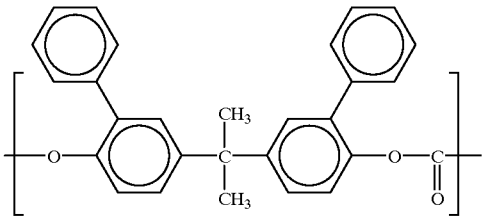
(6-7)
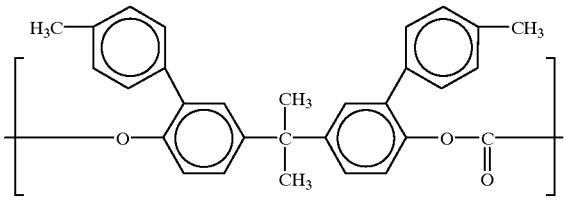
(6-8)
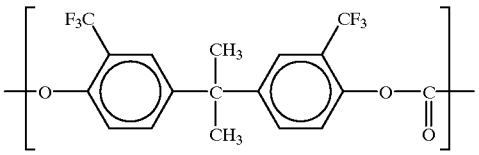
(6-9)
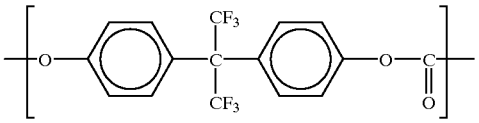

-continued (6-10)

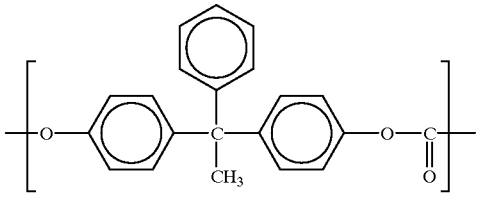

(6-11)

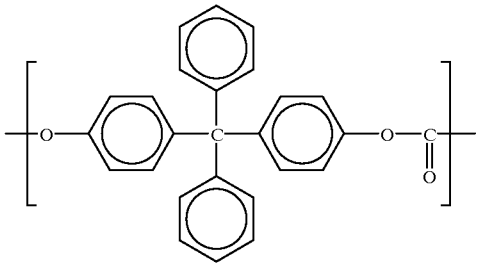

(6-12)

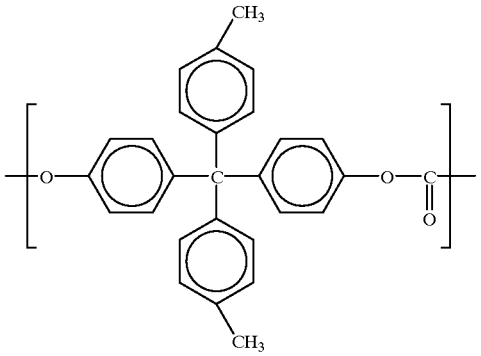

(6-13)

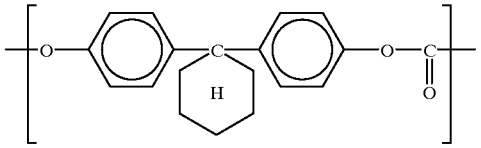

(6-14)

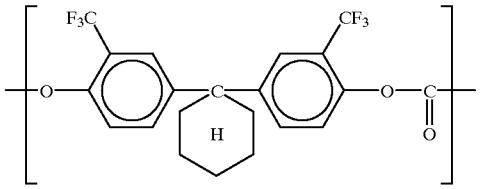

(6-15)

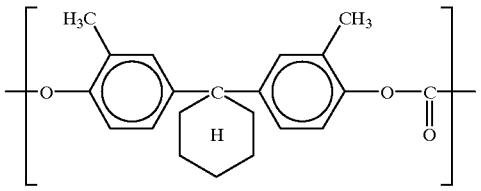

-continued (6-16)

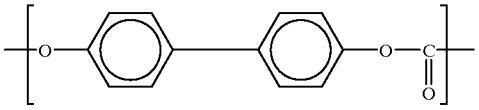

The thickness of the charge transport layer is preferably 5 to 50 $\mu$m, more preferably 10 to 30 $\mu$m. The weight ratio of the charge transport material to the binder resin is 5:1 to 1:5, more preferably 3:1 to 1:3. As the coating method, dip coating, spray coating, spinner coating, blade coating, roll coating, or the like can be used.

Preferably, the diorganopolysiloxane represented by formula (1) is previously mixed with the fluororesin powder and the binder resin, and dispersed therewith. The content of the diorganopolysiloxane is preferably 0.1 to 30 parts by weight, more preferably 3 to 25 parts by weight, based on 100 parts by weight of fluororesin powder. With a too low content, the effect of the present invention cannot be obtained, while with a too high content, carrier trapping occurs, and thus readily causes a potential change. The content of the fluororesin powder is preferably 0.5 to 20 parts by weight based on 100 parts by weight of binder resin. With a content of less than 0.5 part by weight, there is less effect, while with a content of over 25 parts by weight, light transmittance is significantly decreased, causing significant adverse effects on electrophotographic characteristics.

Since a colorant, a dye, an organic charge transport material, and the like are generally weak against ultraviolet rays, ozone, stains of oil or the like, or a metal, in the present invention, a protective layer may be provided according to demand. The protective layer used in the present invention is formed by coating a solution containing the binder resin, the fluororesin powder and the diorganopolysiloxane represented by formula (1) on the photosensitive layer, and then drying the coating. Examples of the binder resin include polyester resins, polycarbonate resins, acrylic resins, methacrylic resins, polyamide resins, polyimide resins, polyarylate resins, polyurethane resins, styrene-butadiene copolymers, styrene-acrylic acid copolymers, styrene-acrylonitrile copolymers, and the like. In the use of a condensation monomer or a radical polymerization monomer having an unsaturated group for the binder resin, the protective layer may be formed by coating, and then curing by applying heat or strong energy light such as ultraviolet rays or the like. If required, conductive particles of a metal or a conductive metal oxide, or a charge transport material may be further added to the protective layer.

The thickness of the protective layer is preferably 0.05 to 20 $\mu$m. Since the protective layer can be made thinner than the charge transport layer, the amounts of the fluororesin powder and diorganopolysiloxane can be increased. Specifically, the diorganopolysiloxane is preferably used in an amount up to 100 parts by weight based on 100 parts by weight of fluororesin powder, and the fluororesin powder is preferably used in an amount of up to 50 parts by weight based on 100 parts by weight of binder resin.

Examples of fluororesin powders include powders of tetrafluoroethylene resins, trifluorochloroethylene resins, tetrafluoroethylene hexafluoroethylenepropylene resins, vinyl fluoride resins, vinylidene fluoride resins, difluorodichloroethylene resins, copolymer resins thereof, and the like. Of these resins, tetrafluoroethylene resins are particularly preferable from the viewpoint of electrophotographic characteristics.

In order to disperse the fluororesin powder, various emulsifiers, dispersers and mixers such as a homogenizer, a line mixer, an ultra disperser, a homomixer, a liquid collision type high-speed disperser, an ultrasonic disperser, and the like can be used.

FIG. 1 shows the schematic construction of an electrophotographic apparatus comprising a process cartridge comprising the electrophotographic photosensitive member of the present invention. Referring to FIG. 1, the electrophotographic apparatus comprises the drum-like electrophotographic photosensitive member 1 of the present invention, which is rotated around a shaft 2 in an arrow direction at a predetermined peripheral speed. In the rotation process, the surface of the photosensitive member 1 is uniformly charged to a positive or negative potential by primary charging means 3, and then subjected to exposure light 4 from exposure means (not shown) by slit exposure or laser beam scanning exposure. As a result, an electrostatic latent image is formed on the surface of the photosensitive member 1.

The thus-formed electrostatic latent image is then developed by development means 5 using a toner, and the developed toner image is transferred by transfer means 6 to a transfer material 7 which is fed between the photosensitive member 1 and the transfer means 6 from a paper feed unit (not shown) in synchronism with rotation of the photosensitive member 1.

The transfer material 7 to which the image is transferred is separated from the surface of the photosensitive member 1 and introduced into image fixing means 8 for fixing an image, and then printed out as a copy to the outside of the apparatus. After transfer of the image, the toner remaining on the surface of the photosensitive member 1 after transfer is removed by cleaning means 9 to form a clean surface, and then the clean surface is further diselectrified by pre-exposure light 10 from pre-exposure means (not shown), and again used for image formation. Where the primary charging means 3 is contact charging means comprising a roller or the like, pre-exposure is not necessarily required.

In the present invention, among the electrophotographic photosensitive member 1, the primary charging means 3, the development means 5, the cleaning means 9, etc., a plurality of components may be integrated to form a process cartridge which is detachably provided on the body of an electrophotographic apparatus such as a copying machine, a laser beam printer, or the like. For example, at least one of the primary charging means 3, the development means 5 and the cleaning means 9 can be supported integrally with the photosensitive member 1 to form a process cartridge 11 which is detachably provided on the body of the apparatus by using guide means such as rails 12 or the like.

In the case of a copying machine or printer as an electrophotographic apparatus, the exposure light 4 is light reflected from or transmitted through an original, or light emitted by laser beam scanning, driving of a LED array, driving of a liquid crystal shutter array, or the like according to a signal obtained by reading an original using a sensor.

The electrophotographic photosensitive member of the present invention can be used for an electrophotographic copying machine, as well as for a laser beam printer, a CRT printer, a LED printer, a liquid crystal printer, and laser plate making in the electrophotographic applied field.

The present invention will be described below with reference to examples. In the description below, "parts" means "parts by weight".

Diorganopolysiloxane used in the present invention can be synthesized as described below in the examples. Synthetic examples are described below.

Synthetic Example 1

3.23 g of polysiloxane represented by the formula below, 20 ppm (5% isopropyl alcohol solution) of platinic chloride, 12.6 g of allyl functional polyoxyethylene represented by $CH_2{=}CHCH_2O(C_2H_4O)_{24}(C_3H_6O)_{24}CH_3$, and 80 g of m-xylene hexafluoride were mixed in a flask, and the resultant mixture was gradually heated.

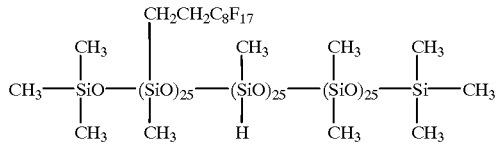

Reaction was further continued at 80° C. for 6 hours. Then, the pressure was reduced to 20 Torr at 140° C. to remove the solvent and low-boiling-point components. As a result of analysis of the thus-obtained product by Si-NMR, $^{13}$C-NMR and FT-IR, the product was found to be diorganopolysiloxane (referred to as "$P_1$" hereinafter) represented by the following formula:

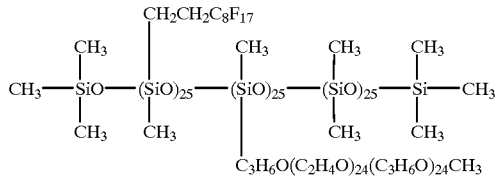

Synthetic Example 2

The procedure of Synthetic Example 1 was repeated except that 10.35 g of dimethylpolysiloxane represented by the formula $CH_2{=}CH((CH_3)_2SiO)_{25}(CH_3)_2SiC_4H_9$ was used in place of ally functional polyoxyethylene to obtain diorganopolysiloxane (referred to as "$P_2$" hereinafter) represented by the following formula:

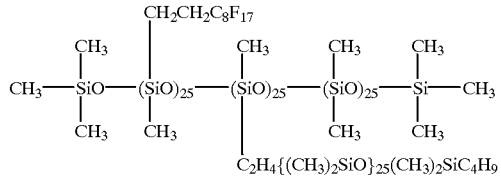

Synthetic Example 3

The procedure of Synthetic Example 1 was repeated except that 2.51 g of α-olefin represented by the formula $CH_2{=}CHC_{16}H_{33}$ was used in place of ally functional polyoxyethylene to obtain diorganopolysiloxane (referred to as "$P_3$" hereinafter) represented by the following formula:

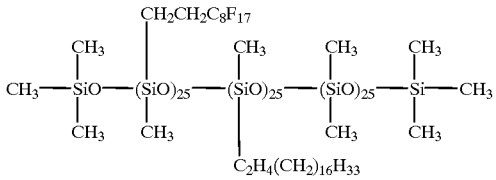

Synthetic Example 4

3.45 g of polysiloxane represented by the formula below, 20 ppm (5% isopropyl alcohol solution) of platinic chloride, 20.5 g of allyl functional dimethylpolysiloxane represented by $CH_2{=}CH((CH_3)_2SiO)_{50}(CH_3)_2SiC_4H_9$, and 80 g of m-xylene hexafluoride were mixed in a flask, and the resultant mixture was gradually heated.

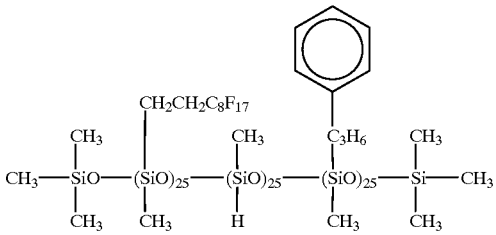

Reaction was further continued at 80° C. for 6 hours. Then pressure was reduced to 20 Torr at 140° C. to remove the solvent and low-boiling-point components. As a result of analysis of the thus-obtained product by Si-NMR, $^{13}$C-NMR and FT-IR, the product was found to be diorganopolysiloxane (referred to as "$P_4$" hereinafter) represented by the following formula:

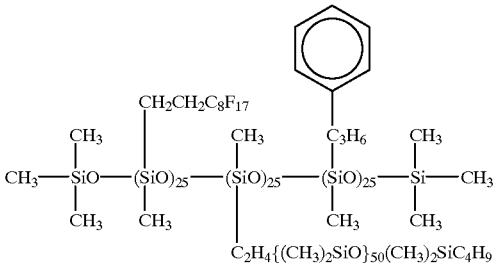

EXAMPLE 1

A coating solution comprising the materials below was coated by a dip coating method on a support member comprising an aluminum cylinder having a diameter of 30 mm and a length of 357.5 mm, and then cured by heating at 140° C. for 30 minutes to form a conductive layer having a thickness of 15 μm.

| | |
|---|---|
| Conductive dye: $SnO_2$-coated barium sulfate | 10 parts |
| Resistance control dye: titanium oxide | 2 parts |
| Binder resin: phenolic resin | 6 parts |
| Leveling agent: silicone oil | 0.001 part |

-continued

| | |
|---|---|
| Solvent: methanol/methoxypropanol (weight ratio: 0.2/0.8) | 20 parts |

On the conductive layer was coated by the dip coating method a solution obtained by dissolving 3 parts of N-methoxymethylated nylon and 3 parts of copolymer nylon in a solvent mixture of 65 parts methanol/30 parts n-butanol, followed by drying to form an intermediate layer having a thickness of 0.5 μm.

4 parts of oxytitanium phthalocyanine having strong peaks at black angles (2θ±0.2) of 9.0°, 14.2°, 23.9° and 27.1° in CuKα characteristic X-ray diffraction, 2 parts of polyvinyl butyral (trade name: S-LEC BM2 produced by Sekisui Chemical Co., Ltd.) and 60 parts of cyclohexane were dispersed by a sand mill using glass beads of Ø 1 mm for 4 hours, and then 100 parts of ethyl acetate was added to the resultant dispersion to prepare a dispersion for a charge generation layer. The thus-prepared dispersion was coated on the intermediate layer by the dip coating method, and then dried to form a charge generation layer having a thickness of 0.3 μm.

In order to form a charge transport layer, a coating solution for the charge transport layer was then prepared. First, 10 parts of polyarylate resin [(viscosity-average molecular weight (referred to as "Mv" hereinafter) 45,000] of Constitutional Unit Example 5-2 was dissolved in 100 parts of chlorobenzene, and 10 parts of tetrafluoroethylene resin powder (produced by Daikin Industries, Ltd., Trade Name: Lubron L-2, primary particle size 0.3 μm, secondary particle size 5 μm) and 2 parts of diorganopolysiloxane ($P_1$) obtained in Synthetic Example 1 were added to the resultant solution, followed by agitation. The thus-obtained mixture was dispersed twice by using a liquid collision type disperser to prepare a fluororesin powder dispersion.

To the fluororesin powder dispersion were added the polyacrylate resin, amine compounds A and B represented by the following formulae, and a solvent so that the final weight ratios of the polyarylate resin, amine compound A, amine compound B, tetrafluoroethylene, diorganopolysiloxane, and the solvent were 10 parts, 9 parts, 1 part, 1 part, 0.2 parts and 80 parts, respectively.

Amine compound A

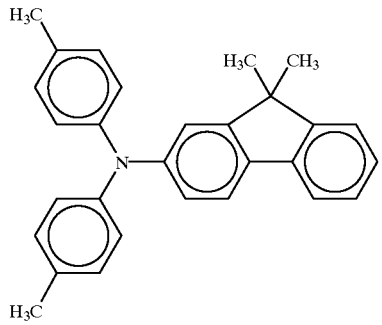

Amine compound B

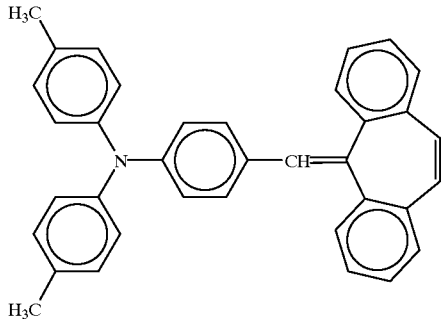

The solvent was prepared so that the final weight ratio of monochlorobenzene/dichlorobenzene was 1:1. The coating solution was coated on the charge generation layer by the dip coating method, and then dried at 130° C. for 1 hour to form a charge transport layer having a thickness of 3 μm.

Evaluation will be described below. A modified machine (21 sheets/min.) of a copying machine GP211 produced by Canon Inc. was used as an apparatus. A high-voltage source substrate was modified so that primary charging was performed during rotation of an electrophotographic photosensitive member. Also a cleaning blade was modified so that the pressure of a portion in contact with the electrophotographic photosensitive member was increased by 30% as compared with ordinary apparatus. In a test, image formation was repeated until fogging occurred over the entire surface of an image in a mode in which after copying was performed at 23° C. and humidity of 50% RH, copying was stopped and then immediately started. An image of a A4-size character pattern was printed with a printing ratio of 5%.

Also the surface potential was measured in the initial stage and after the durability of 30,000 sheets to examine a potential difference (ΔV1) of a light portion. The potential difference ΔV1 was calculated by {(absolute value of potential of a light portion after durability of 30,000 sheets)−(absolute value of initial potential of a light portion)}. The quantity of light was set so that the initial potential of a light portion was −200 V. Furthermore, the angle of contact between the surface of the photosensitive member and pure water was examined in the initial stage and after the durability. The results of these tests are shown in Table 1.

EXAMPLES 2 to 5

Example 1 was repeated except that a polyarylate resin of Constitutional Unit Example 5-1 (Mv=44,000), a polycarbonate resin of Constitutional Unit Example 6-2 (Mv=42,000), a polycarbonate resin of Constitutional Unit Example 6-13 (Mv=40,000), and a copolymer polycarbonate (Mv=43,000) containing Constitutional Unit Examples 6-16 and 6-1 at a molar ratio of 1:1 were respectively used as binder resins for the charge transport layer so that electrophotographic photosensitive members were produced and evaluated. The results are shown in Table 1.

EXAMPLES 6 to 10

Examples 1 to 5 were respectively repeated except that diorganopolysiloxane ($P_2$) obtained in Synthetic Example 2 was used as diorganopolysiloxane so that electrophotographic photosensitive members were produced and evaluated. The results are shown in Table 1.

EXAMPLES 11 to 15

Examples 1 to 5 were respectively repeated except that diorganopolysiloxane ($P_3$) obtained in Synthetic Example 3 was used as diorganopolysiloxane so that electrophotographic photosensitive members were produced and evaluated. The results are shown in Table 1.

EXAMPLES 16 to 20

Examples 1 to 5 were respectively repeated except that diorganopolysiloxane ($P_4$) obtained in Synthetic Example 4 was used as diorganopolysiloxane so that electrophotographic photosensitive members were produced and evaluated. The results are shown in Table 1.

TABLE 1

| Example | Durability (number of copies obtained until fogging occurred over the entire image) | ΔV1 (V) | Contact Angle (degree) Initial stage | Contact Angle (degree) After completion of durability |
|---|---|---|---|---|
| 1 | 48,000 | 25 | 95 | 94 |
| 2 | 43,000 | 35 | 95 | 93 |
| 3 | 42,000 | 0 | 93 | 91 |
| 4 | 40,000 | 5 | 94 | 92 |
| 5 | 42,000 | 15 | 94 | 93 |
| 6 | 51,000 | 30 | 93 | 91 |
| 7 | 50,000 | 25 | 94 | 92 |
| 8 | 47,000 | 10 | 95 | 92 |
| 9 | 48,000 | 10 | 96 | 95 |
| 10 | 46,000 | 5 | 95 | 94 |
| 11 | 43,000 | 35 | 93 | 92 |
| 12 | 43,000 | 30 | 94 | 92 |
| 13 | 42,000 | 5 | 93 | 93 |
| 14 | 41,000 | 10 | 93 | 91 |
| 15 | 42,000 | 5 | 93 | 91 |
| 16 | 48,000 | 10 | 91 | 90 |
| 17 | 47,000 | 5 | 95 | 91 |
| 18 | 43,000 | 0 | 95 | 91 |
| 19 | 44,000 | 0 | 95 | 90 |
| 20 | 53,000 | 5 | 94 | 91 |

EXAMPLE 21

Example 1 was repeated up to the formation of a charge generation layer, and then a charge transport layer was formed as described below.

10 parts of polycarbonate resin (Mv=40,000) of Constitutional Unit Example 6-13 and 8 parts of amine compound B were dissolved in a solvent mixture of 40 parts chlorobenzene/40 parts dichloromethane to form a coating solution. The thus-obtained coating solution was coated on the charge generation layer by the dip coating method, and then dried at 130° C. for 1 hour to form a charge transport layer having a thickness of 20 μm.

Then, a protective layer was formed according to the following procedure.

First, 100 parts of antimony-containing tin oxide fine particles (produced by Mitsubishi Materials Corporation, Trade Name: T1) having an average particle diameter of 0.02 μm, 30 parts of (3,3,3-trifluoropropyl) trimethoxysilane (produced by Shin-Etsu Chemical Co., Ltd.) and 300 parts of 95% ethanol aqueous solution were mixed. The resultant mixture was dispersed by a milling device for 1 hour, and filtered, and the residue was washed with ethanol, dried and then heated at 120° C. for 1 hour to treat the surfaces of the tin oxide fine particles.

Then, 25 parts of acryl monomer below, 0.5 part of 2-methylthioxanthone, 35 parts of the surface-treated tin oxide particles, and 300 parts of toluene were mixed and then dispersed by a sand mill for 96 hours to obtain a dispersion. The thus-obtained dispersion was mixed with 25 parts of tetrafluoroethylene resin powder (Daikin Industries Co., Ltd., Trade Name: Lubron L-2, primary particle diameter 0.3 μm, secondary particle diameter 5 μm) and 10 parts of diorganopolysiloxane ($P_2$) obtained in Synthetic Example 2, followed by dispersion using a sand mill for 8 hours to form a fluororesin dispersion. The thus-formed fluororesin dispersion was coated on the charge generation layer by spray coating, dried, and then irradiated with ultraviolet rays for 15 seconds using a high-pressure mercury-vapor lamp with a light strength of 800 mW/cm$^2$ to form a protective layer having a thickness of 4 μm.

The electrophotographic photosensitive member obtained was evaluated by the same method as Example 1. The results are shown in Table 2.

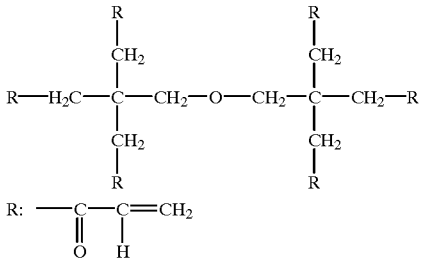

EXAMPLE 22

Example 21 was repeated up to the formation of a charge transport layer, and then a protective layer was formed as described below.

First, 35 parts of polycarbonate resin (Mv=89,000) of Constitutional Unit Example 6-13 was dissolved in 100 parts of chlorobenzene, and 5 parts of tetrafluoroethylene resin powder (Daikin Industries Co., Ltd., Trade Name: Lubron L-2, primary particle diameter 0.3 μm, secondary particle diameter 5 μm) and 2 parts of diorganopolysiloxane ($P_2$) obtained in Synthetic Example 2 were added to the resultant solution, followed by sufficient shaking. The thus-obtained mixture was dispersed twice by using a liquid collision type disperser to prepare a fluororesin powder dispersion.

Then, a polycarbonate resin of Constitutional Unit Example 6-13, amine compound B and a solvent were added to the fluororesin powder dispersion so that the weight ratios of the polycarbonate resin, amine compound B, tetrafluoroethylene, and the solvent were finally 2 parts, 1 part, 1 part, and 100 parts, respectively. The solvent was prepared so that the monochlorobenzene/dichloromethane ratio was 1:1 in the final system. The thus-obtained coating solution was coated on the charge generation layer by a spray coating method, and then dried for 1 hour to form a protective layer having a thickness of 6 μm.

The electrophotographic photosensitive member obtained was evaluated by the same method as Example 1. The results are shown in Table 2.

TABLE 2

| Example | Durability (number of copies obtained until fogging occurred over the entire image) | ΔV1 (V) | Contact Angle (degree) Initial stage | Contact Angle (degree) After completion of durability |
|---|---|---|---|---|
| 21 | 62,000 | −10 | 97 | 85 |
| 22 | 75,000 | −15 | 108 | 105 |

The surface layer coating solution prepared in each of Examples 1 to 22 was a good dispersion which caused neither aggregation nor deposition of the fluororesin powder after allowing to stand for 1 hour.

Comparative Examples 1 to 3

Examples 1, 6 and 11 were respectively repeated except that 1 part of polymethyl methacrylate (Trade Name: Aron GF300 produced by Toa Gosei) to which a fluorine component was grafted was used in place of diorganopolysiloxane so that electrophotographic photosensitive members were produced and evaluated. The results are shown in Table 3.

Comparative Example 4

Example 22 was repeated except that 1 part of polymethyl methacrylate (Trade Name: Aron GF300 produced by Toa Gosei) to which a fluorine component was grafted was used in place of diorganopolysiloxane so that a electrophotographic photosensitive member was produced and evaluated. The results are shown in Table 3.

Comparative Examples 5 and 6

Examples 1 and 4 were respectively repeated except that tetrafluoroethylene resin powder and diorganopolysiloxane were not used so that electrophotographic photosensitive members were produced and evaluated. The results are shown in Table 3.

TABLE 3

| Comparative Example | Durability (number of copies obtained until fogging occurred over the entire image) | ΔV1 (V) | Contact Angle (degree) Initial stage | Contact Angle (degree) After completion of durability |
|---|---|---|---|---|
| 1 | 46,000 | 155 | 86 | 75 |
| 2 | 40,000 | 110 | 85 | 73 |
| 3 | 38,000 | 140 | 85 | 70 |
| 4 | 72,000 | 80 | 100 | 101 |
| 5 | 31,000 | 30 | 85 | 65 |
| 6 | 25,000 | 35*) | 86 | 67 |

*) Potential difference in a light portion after printing of 25,000 sheets

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic photosensitive member comprising:

a support member; and a photosensitive layer formed on the support member;

wherein a surface layer of the electrophotographic photosensitive member contains diorganopolysiloxane represented by the following formula (1):

(1)

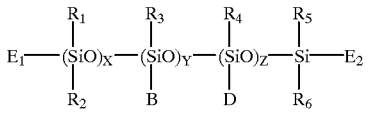

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$, B and D; X represents an integer of 0 to 1000; and Y and Z independently represent an integer of 1 to 1000.

2. An electrophotographic photosensitive member according to claim 1, wherein $R_1$ to $R_6$ are each a methyl group or a phenyl group.

3. An electrophotographic photosensitive member according to claim 1, wherein an organic group having a perfluoroalkyl group is represented by the following formula (2):

$$—R_7—(CF_2)_a—F \quad (2)$$

wherein $R_7$ represents an alkylene or alkyleneoxyalkylene group, and a represents an integer of 3 or more.

4. An electrophotographic photosensitive member according to claim 1, wherein an organic group having a polyoxyalkylene group is represented by the following formula (3):

$$—(R_8)_b—O—(R_9O)_c—R_{10} \quad (3)$$

wherein $R_8$ and $R_9$ independently represent a hydrocarbon group, $R_{10}$ represents a hydrogen atom, a hydrocarbon group, or an acyl group, b represents 0 or 1, and c represents an integer of 1 to 300.

5. An electrophotographic photosensitive member according to claim 4, wherein c is 5 or more.

6. An electrophotographic photosensitive member according to claim 1, wherein an organic group having a siloxane chain is represented by the following formula (4):

(4)

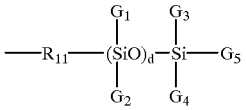

wherein $R_{11}$ represents an alkylene group, an alkyleneoxy group or an oxygen atom, $G_1$ to $G_5$ independently represent an alkyl group or an aryl group, and d represents an integer of 3 or more.

7. An electrophotographic photosensitive member according to claim 6, wherein is d 5 or more.

8. An electrophotographic photosensitive member according to claim 1, wherein the total X+Y+Z is 2 to 2000.

9. An electrophotographic photosensitive member according to claim 1, wherein the surface layer of the electrophotographic photosensitive member further contains a fluororesin powder.

10. An electrophotographic photosensitive member according to claim 9, wherein the surface layer of the electrophotographic photosensitive member further contains a binder resin.

11. An electrophotographic photosensitive member according to claim 10, wherein the binder resin is a polyarylate resin or polycarbonate resin.

12. A process cartridge comprising:

an electrophotographic photosensitive member comprising a support member and a photosensitive layer formed thereon; and at least one means selected from the group consisting of charging means, development means and cleaning means;

wherein the electrophotographic photosensitive member and the at least one means are integrally supported and detachable from the body of the electrophotographic apparatus; and a surface layer of the electrophotographic photosensitive member contains diorganopolysiloxane represented by the following formula (1):

(1)

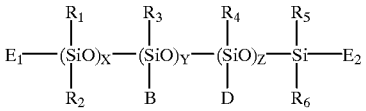

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$, B and D; X represents an integer of 0 to 1000; and Y and Z independently represent an integer of 1 to 1000.

13. A process cartridge according to claim 12, wherein $R_1$ to $R_6$ are each a methyl group or a phenyl group.

14. A process cartridge according to claim 12, wherein an organic group having a perfluoroalkyl group is represented by the following formula (2):

$$—R_7—(CF_2)_a—F \quad (2)$$

wherein $R_7$ represents an alkylene or alkyleneoxyalkylene group, and a represents an integer of 3 or more.

15. A process cartridge according to claim 12, wherein an organic group having a polyoxyalkylene group is represented by the following formula (3):

$$—(R_8)_b—O—(R_9O)_c—R_{10} \quad (3)$$

wherein $R_8$ and $R_9$ independently represent a hydrocarbon group, $R_{10}$ represents a hydrogen atom, a hydrocarbon group, or an acyl group, b represents 0 or 1, and c represents an integer of 1 to 300.

16. A process cartridge according to claim 15, wherein c is 5 or more.

17. A process cartridge according to claim 12, wherein an organic group having a siloxane chain is represented by the following formula (4):

(4)

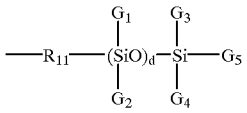

wherein $R_{11}$ represents an alkylene group, an alkyleneoxy group or an oxygen atom, $G_1$ to $G_5$ independently represent an alkyl group or an aryl group, and a represents an integer of 3 or more.

18. A process cartridge according to claim 17, wherein d is 5 or more.

19. A process cartridge according to claim 12, wherein the total X+Y+Z is 2 to 2000.

20. A process cartridge according to claim 12, wherein the surface layer of the electrophotographic photosensitive member further contains a fluororesin powder.

21. A process cartridge according to claim 20, wherein the surface layer of the electrophotographic photosensitive member further contains a binder resin.

22. A process cartridge according to claim 21, wherein the binder resin is a polyarylate resin or polycarbonate resin.

23. An electrophotographic apparatus comprising an electrophotographic photosensitive member comprising a support member and a photosensitive layer formed thereon, charging means, exposure means, development means and transfer means, wherein a surface layer of the electrophotographic photosensitive member contains diorganopolysiloxane represented by the following formula (1):

(1)

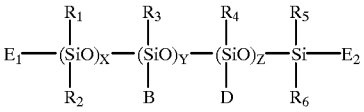

wherein $R_1$ to $R_6$ independently represent a substituted or unsubstituted hydrocarbon group; B represents a substituted or unsubstituted organic group containing a perfluoroalkyl group; D represents a group selected from the group consisting of a substituted or unsubstituted organic group containing a polyoxyalkylene group, a substituted or unsubstituted alkyl group having at least 12 carbon atoms, and a substituted or unsubstituted organic group having a siloxane chain; $E_1$ and $E_2$ independently represent a group selected from groups of $R_1$, B and D; X represents an integer of 0 to 1000; and Y and Z independently represent an integer of 1 to 1000.

24. An electrophotographic apparatus according to claim 23, wherein $R_1$ to $R_6$ are each a methyl group or a phenyl group.

25. An electrophotographic apparatus according to claim 23, wherein an organic group having a perfluoroalkyl group is represented by the following formula (2):

$$—R_7—(CF_2)_a—F \quad (2)$$

wherein $R_7$ represents an alkylene or alkyleneoxyalkylene group, and a represents an integer of 3 or more.

26. An electrophotographic apparatus according to claim 23, wherein an organic group having a polyoxyalkylene group is represented by the following formula (3):

$$—(R_8)_b—O—(R_9O)_c—R_{10} \quad (3)$$

wherein $R_8$ and $R_9$ independently represent a hydrocarbon group, $R_{10}$ represents a hydrogen atom, a hydrocarbon group, or an acyl group, b represents 0 or 1, and c represents an integer of 1 to 300.

27. An electrophotographic apparatus according to claim 26, wherein c is 5 or more.

28. An electrophotographic apparatus according to claim 23, wherein an organic group having a siloxane chain is represented by the following formula (4):

(4)

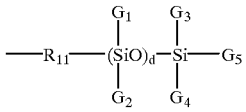

wherein $R_{11}$ represents an alkylene group, an alkyleneoxy group or an oxygen atom, $G_1$ to $G_5$ independently represent an alkyl group or an aryl group, and d represents an integer of 3 or more.

29. An electrophotographic apparatus according to claim 28, wherein d is 5 or more.

30. An electrophotographic apparatus according to claim 23, wherein the total X+Y+Z is 2 to 2000.

31. An electrophotographic apparatus according to claim 23, wherein the surface layer of the electrophotographic photosensitive member further contains a fluororesin powder.

32. An electrophotographic apparatus according to claim 31, wherein the surface layer of the electrophotographic photosensitive member further contains a binder resin.

33. An electrophotographic apparatus according to claim 32, wherein the binder resin is a polyarylate resin or polycarbonate resin.

* * * * *

UNITED STATES PATENT AND TRADEMARK OFFICE

CERTIFICATE OF CORRECTION

PATENT NO. : 6,203,954 B1
DATED : March 20, 2001
INVENTOR(S) : Hideki Anayama

It is certified that error appears in the above-identified patent and that said Letters Patent is hereby corrected as shown below:

Title page,
Item [54], Title, "MEMBER" should read -- MEMBER, --.

Item [57], ABSTRACT,
Line 17, "D," should read -- D; --;
Line 18, "1000," should read -- 1000; --.

Column 1,
Line 2, "MEMBER" should read -- MEMBER, --;
Line 51, "of" should read -- of the --.

Column 2,
Line 34, "$R_1$ B" should read -- $R_1$, B --.

Column 3,
Line 23, "like;" should read -- like. --.

Column 4,
Line 3, "sents" should read -- sent --.

Column 21,
Line 29, "with" should read -- with an --;
Line 33, "of a" should read -- of an --.

Column 24,
Line 20, "a" should read -- an --.

UNITED STATES PATENT AND TRADEMARK OFFICE

CERTIFICATE OF CORRECTION

PATENT NO. : 6,203,954 B1
DATED : March 20, 2001
INVENTOR(S) : Hideki Anayama

It is certified that error appears in the above-identified patent and that said Letters Patent is hereby corrected as shown below:

Column 25,
Line 57, "is d 5" should read -- d is 5 --.

Column 27,
Line 10, "a" should read -- d --.

Signed and Sealed this

Twenty-sixth Day of March, 2002

*Attest:*

*Attesting Officer*

JAMES E. ROGAN
*Director of the United States Patent and Trademark Office*